United States Patent [19]

Sedam

[11] Patent Number: 4,773,561

[45] Date of Patent: Sep. 27, 1988

[54] WATER RESERVOIR ASSEMBLY FOR POST-MIX BEVERAGE DISPENSER

[75] Inventor: Jason K. Sedam, Dunwoody, Ga.

[73] Assignee: The Coca-Cola Company, Atlanta, Ga.

[21] Appl. No.: 55,848

[22] Filed: Jun. 1, 1987

Related U.S. Application Data

[62] Division of Ser. No. 887,220, Jul. 21, 1986, Pat. No. 4,703,870.

[51] Int. Cl.[4] ..... B67D 5/56

[52] U.S. Cl. ..... 222/129.1; 222/325; 222/478; 222/481; 220/373

[58] Field of Search ..... 222/129.1–129.4, 222/325, 481, 478; 220/373, 374, 1 C

[56] References Cited

U.S. PATENT DOCUMENTS

| | | | |
|---|---|---|---|
| 3,915,341 | 10/1975 | Brown | 222/325 X |
| 4,316,557 | 2/1982 | Benoun et al. | 222/135 X |
| 4,632,268 | 12/1986 | Melzi et al. | 215/10 X |
| 4,640,446 | 2/1987 | Walker | 222/478 X |
| 4,673,081 | 6/1987 | Habig et al. | 220/1 C X |
| 4,703,870 | 11/1987 | Sedam | 222/325 X |

*Primary Examiner*—Joseph J. Rolla
*Assistant Examiner*—Gregory L. Huson
*Attorney, Agent, or Firm*—Birch, Stewart, Kolasch & Birch

[57] ABSTRACT

A manually-refillable water reservoir assembly, which may be retrofit to a post-mix beverage dispenser to supply water from the reservoir instead of from a commercial water supply, includes a manually-refillable water container which plugs into a base assembly. The base assembly includes a socket for receiving the container, and the container includes a side opening for filling and a vent placed above the same operative when both filling the container while resting on it's side, and in the dispensing position.

2 Claims, 2 Drawing Sheets

FIG. 3
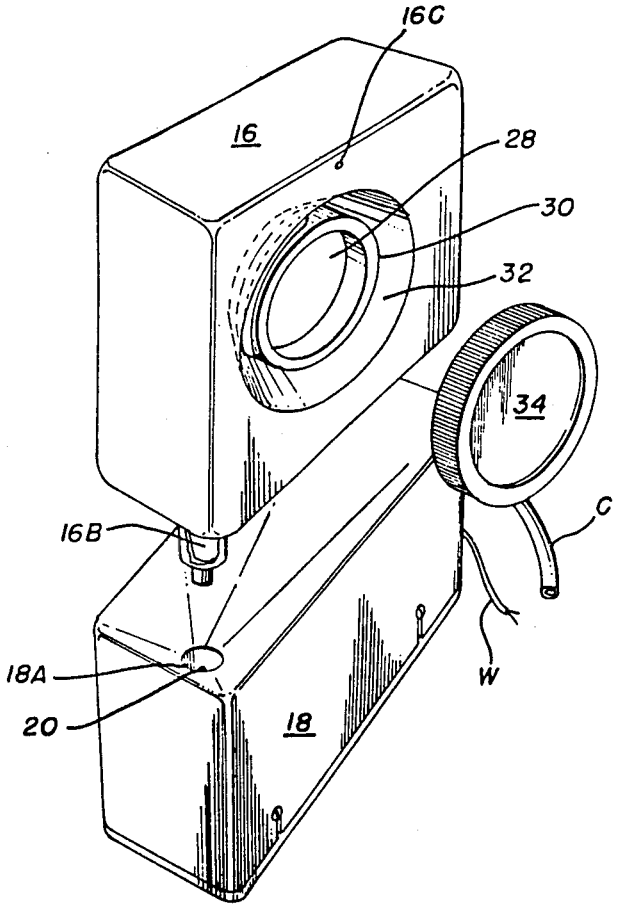
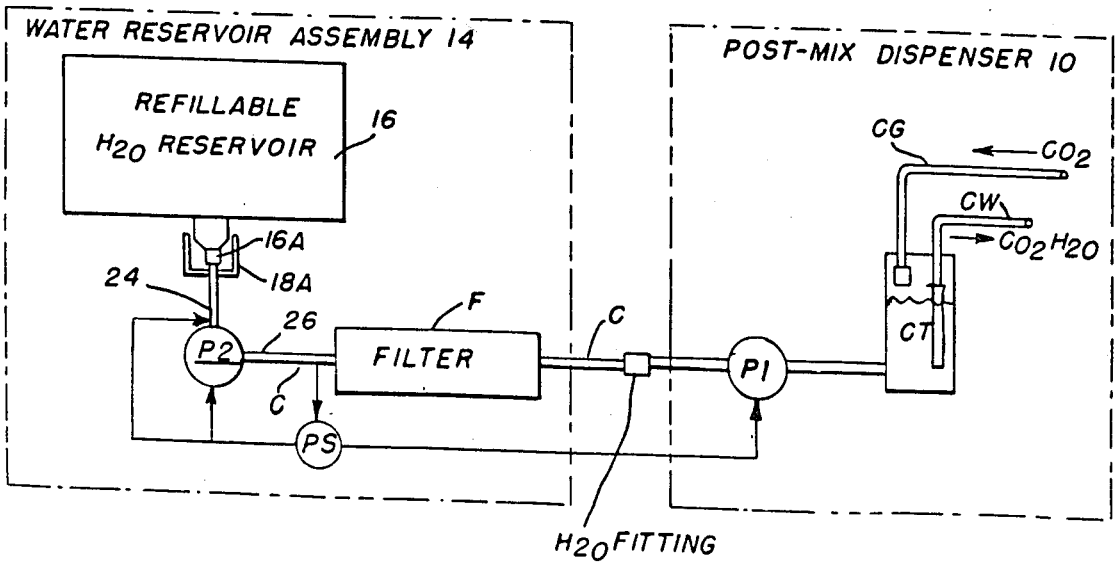
FIG. 4

WATER RESERVOIR ASSEMBLY FOR POST-MIX BEVERAGE DISPENSER

BACKGROUND OF THE INVENTION

This application is a divisional of copending application Ser. No. 887,220, filed on July 21, 1986, now U.S. Pat. No. 4,703,870.

The present invention relates to a manually-refillable water reservoir assembly capable of being retrofit to a post-mix beverage dispenser which is normally plumbed to a commercial water supply. More specifically, the present invention relates to a manually-refillable water reservoir assembly for connection in line to a pressure pump of the water supply system associated with the carbonator of a conventional post-mix beverage dispenser.

Post-mix beverage dispensers designed for use with city water supplies generally have pressure pumps for delivering water to the carbonator thereof from the commercial water supply. These dispensers have predetermined water pressures and flow rates which are desirable for proper operation of the system and the provision of a pressure pump assures the supply of water to the dispenser at these proper flow rates and pressures. An example of such a post-mix beverage dispenser is described in U.S. Pat. No. 4,496,080 to Farber, et al., assigned to the same assignee as the present invention. In the Farber dispenser, the preferred water pressure flowing to the pump thereof to prevent cavitation is 1 bar gauge, and the preferred water flow rate to the carbonator achieved by the tubine-type pump therein is 1.3 liters per minute.

In order to successfully retrofit a manually-refillable water reservoir assembly to the water inlet fitting of the Farber dispenser, or other forms of dispensers generally designed for use with a commercial water supply, it would be desirable to utilize the existing water supply systems and carbonators of those dispensers without any changes thereto. That is, it would be desirable to connect the output of a manually-refillable water reservoir assembly directly to the inlet of the dispenser which is normally coupled to a commercial water supply. However, in order to do this, the water supply from the manually-refillable water reservoir assembly must be supplied at water pressures and flow rates which are compatible with the water pressure and flow rates required by the pump within the dispenser.

To achieve compatible flow rates and pressures, it is necessary to supply water from the manually-refillable water reservoir through a pump which is electrically connected in parallel and fluidly in series with the pump provided in the main dispenser housing. However, the connection of plural pumps in series fluidly can pose problems in operation of the respective pumps, unless each pump has compatible flow rates and performance. It would be desirable to achieve compatible operation with respect to flow rates and pressure in the respective pumps without the need for sophisticated control systems associated with the pumps.

SUMMARY OF THE INVENTION

Accordingly, it is a primary object of the present invention to provide a manually-refillable water reservoir assembly which may be retrofit to a post-mix beverage dispenser which is normally supplied with water from a commercial supply.

It is another object of the present invention to provide a manually-refillable water reservoir assembly including a pumping system which is compatible in operation with the pumping system contained in the conventional post-mix beverage dispenser.

It is a further object of the present invention to optionally supply filtered tap water to a post-mix beverage dispenser from a refillable reservoir.

It is still a further object of the present invention to provide a removable and refillable water container for the reservoir assembly sized to promote frequent filling, to thereby promote sanitation and eliminate the potential of repetitive refill in-place of the container.

It is yet another object of the present invention to provide a container for a water reservoir assembly which must be removed from a base assembly to refill with water, and may then be plugged into a socket in the base assembly in a rapid and efficient manner.

It is a further object of the present invention to provide a refillable container for a water reservoir assembly which may be removed essentially horizontally from the front of a beverage dispenser, with the exception of a limited vertical movement to unplug the same from a base assembly, so that all ingredients for making a post-mix beverage, including water, syrup and $CO_2$ may be replenished from the front of the dispenser cabinet.

It is still a further object of the present invention to provide a water reservoir assembly fabricated from materials which are non-reactive with water and chlorine to prevent the creation of an off-taste in the beverage.

The objects of the present invention are fulfilled by providing a post-mix beverage dispenser comprising: a carbonator for generating a supply of carbonator water; a first pump having an inlet and an outlet for supplying water to the carbonator, said first pump receiving water at said inlet at a predetermined pressure and flow rate to achieve proper operation thereof; a manually refillable water reservoir assembly; a second pump having an inlet coupled to said reservoir and an outlet through which water is pumped from said reservoir to said second pump at said predetermined pressure and flow rate; and conduit means for connecting the inlet of the first pump to the outlet of the second pump; whereby water from the reservoir is pumped to the carbonator by the first and second pumps.

The respective pumps may be coupled to a safety pressure switch which senses a low level of water in the reservoir. This safety switch will shut off both pumps when a low water level is sensed.

In one embodiment, an optional activated charcoal water filter is provided in the conduit means between the first pump and the second pump, to provide filtered water to the dispenser. The pressure drop caused by the presence of the filter in the conduit is conpensated for by the presence of the second pump between the filter and the water reservoir.

The manually-refillable water reservoir assembly for supplying water to the post-mix beverage dispenser at a pressure and flow rate compatible with the operation of the water system of the dispenser comprises: a manually-refillable water container including a sealable access opening through which it is fillable with water, a discharge spout in a bottom wall thereof, and a normally-closed check valve in the discharge spout; and a water processing system including a housing having a socket for removably receiving the discharge spout of the container, a pump having an inlet fluidly connected to the socket and an outlet for the supply water to the dispenser, and an actuator in the socket for opening the check valve in response to the spout of the container being plugged into the socket.

The container in the water reservoir assembly has the sealable access means mounted in a sidewall thereof; and a suitable vent is disposed in the same sidewall above the access opening. This location of the vent assures that the vent is always above the water level during either the filling or the dispensing operation. That is, when the spout of the container is plugged into the socket of the water processing system, the vent is at the top above the water line of the container. Likewise, when the container is placed on its sidewall opposite to the access opening for refilling from a water tap, the vent is also in a position above the water line. Therefore, the vent is properly located in either of these respective positions to assist in the dispensing or permit the refilling of the water container.

BRIEF DESCRIPTION OF THE DRAWINGS

The objects of the present invention will become more readily apparent by reference to the drawings wherein like reference numerals refer to like parts, and wherein:

FIG. 3 is a right-and top-side perspective of the water reservoir assembly of FIG. 2; and FIG. 4 is a schematic diagram illustrating how the respective water supply systems of the water reservoir assembly of the present invention, and the post-mix beverage dispenser of a conventional plumbed type, are interconnected in accordance with the teachings of the present invention.

DETAILED DESCRIPTION OF THE PREFERRED EMBODIMENTS

Figure 1:
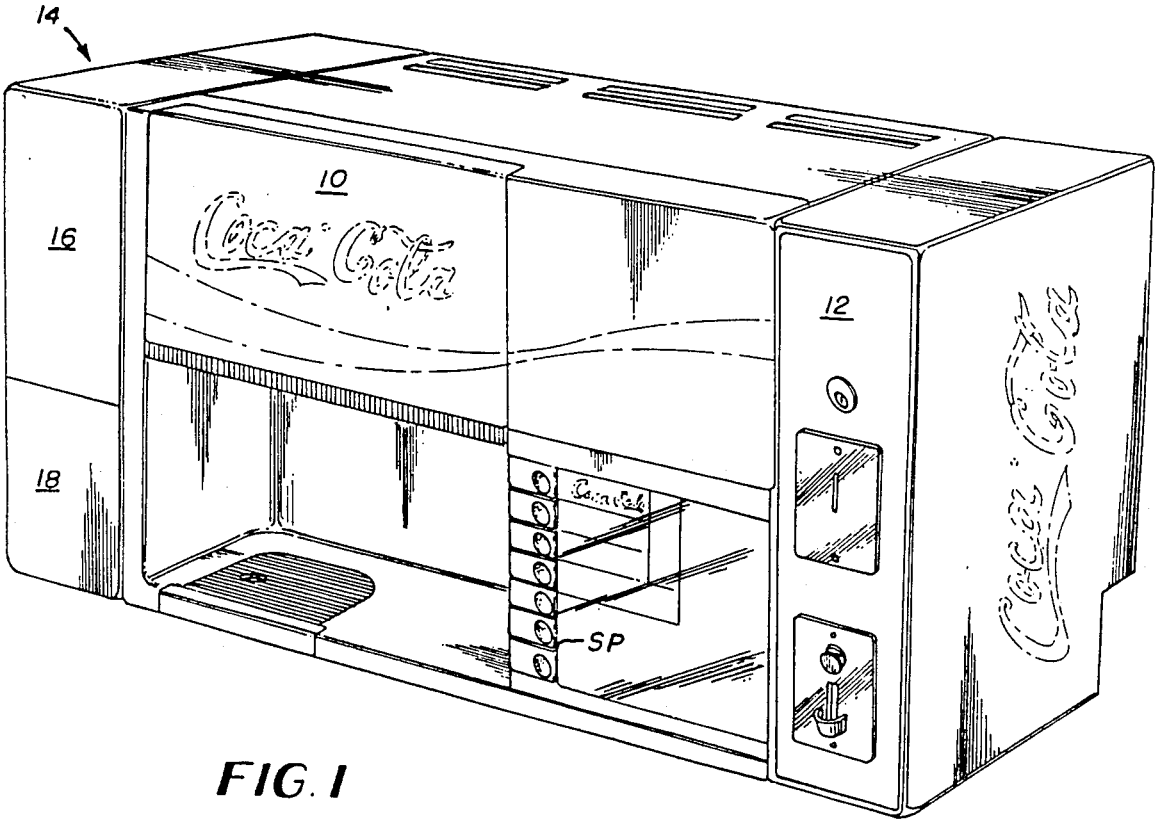
FIG. 1 is a perspective view of a post-mix beverage dispenser illustrating a manually-refillable water reservoir assembly of the present invention attached to the left side of the dispenser cabinet.

Referring to FIG. 1, there is generally indicated a post-mix beverage dispenser 10 of a conventional type which is normally supplied with water from a commercial water supply. The beverage dispenser 10 may be of the type disclosed in U.S. Pat. No. 4,496,080 to Farber, et al. assigned to the same assignee of the present invention. The disclosure of that U.S. Patent is incorporated herein by reference.

Adjacent the left side of the beverage dispenser 10, there is provided the manually-refillable water reservoir assembly 14 of the present invention, including a top water container portion 16 and a base assembly 18, the details of which will be described hereinafter with respect to FIGS. 2 and 3. However, assembly 14 may be disposed remotely from the cabinet if desired. Attached to the right side of the dispenser 10 is an optional coin validator mechanism 12. the validator mechanism 12 may be used if the dispenser is located in a commercial establishment unattended by operators. The dispenser 10 is normally provided with a water inlet fitting on the back side of the cabinet behind the selection panel SP, and the water handling and carbonator system (not shown).

Figure 2:
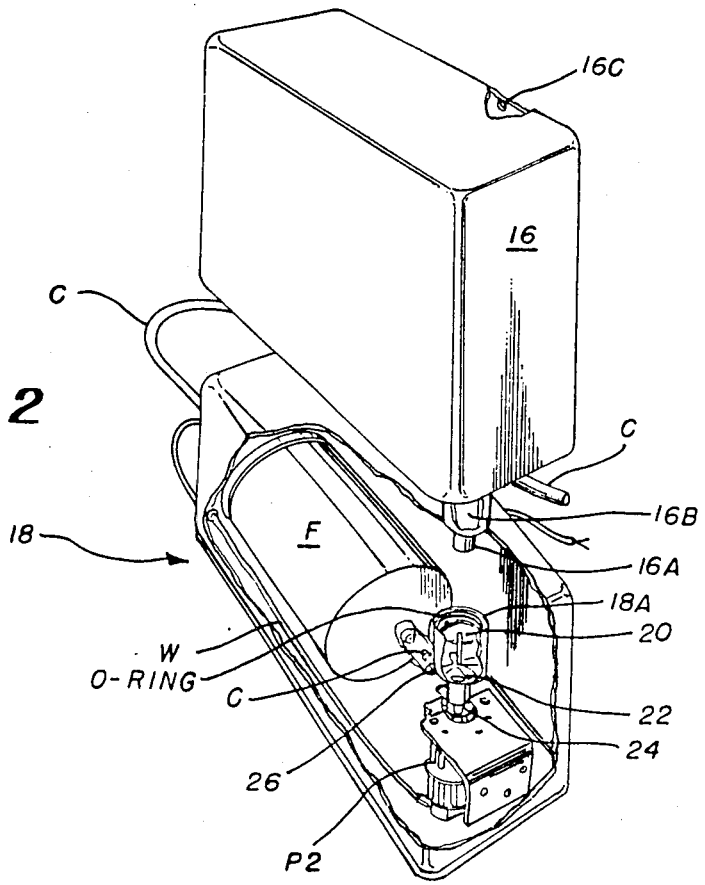
FIG. 2 is a left- and top-side perspective of the manually-refillable water reservoir assembly of the present invention, exploded to show the respective assembly portions prior to their connection.

Referring to FIGS. 2 and 3, the water reservoir assembly 14 includes a top container 16 having a base wall including a discharge spout 16A. Disposed within discharge spout 16A is a ball check valve 16B which is normally closed when container 16 is filled with water, and positioned in the orientation illustrated. Container 16 is preferably transparent, so that one may visually observe the quantity of water in the container at any given time. It is also clear from reference to FIG. 2 that the bottom wall on the interior of container 16 slopes slightly toward the discharge spout 16A to facilitate the gravity flow dispensing of water through the spout once the check valve 16B becomes open.

The water reservoir assembly also includes a base section or assembly 18, including a centrifugal pump P2, a socket 20, and an activated carbon filter F. The pump P2 has an inlet 24 in fluid communication with the socket 18A, and an outlet 26 connected via a conduit C to the optional filter F. Within the socket 18A, there is provided an an o-ring seal and an actuating stem 20 supported on a spider 22 for operative interaction with the ball check valve 16B in spout 16A. That is, when container 16 is plugged into socket 18A with spout 16A, the actuating stem 20 displaces ball check valve 16B upwardly, permitting water to flow by gravity from container 16 into socket 18A and the inlet 24 of pump P2. Pump P2 will then pump this water through filter F and conduit C, to the water fitting at the rear of the dispenser 10 and into the water system of the dispenser 10, in a manner to be described hereinafter with respect to FIG. 4.

Also illustrated in FIG. 3 is an access opening 28 through one sidewall of the water container 16, a threaded rim 30 surrounding access opening 28, and a recessed annulus 32. Access opening 28 is preferably large enough to permit an operator's hand to reach into the interior of the container 16 for cleaning and sanitizing the same. A threaded cap 34 screws onto rim 30 to close the access opening. Opening 28 may be disposed even lower on the sidewall than illustrated to preclude refilling in place.

A vent 16C is provided in the sidewall of container 16 above the access opening 28. This location of vent 16C is very significant in that the vent 16C will be located above the water line within container 16 in all operative positions of the container 16. For example, when the container 16 is plugged into the base assembly 18, the vent 16C is clearly above the water line within the container, and therefore functions properly to allow water to flow from the container. However, even in a position in which the container is being refilled wherein the container will be placed on its sidewall opposite to the opening 28, the vent 16C is still disposed above the water line. Therefore, the vent 16C is still in an advantageous position with respect to refilling of the container. That is, water will not run out of vent 16C.

FIG. 4 illustrates the manner in which the respective water systems of the water reservoir assembly 14 and the post-mix beverage dispenser 10 are connected together in order to achieve compatible flow rates and water pressures in the two respective systems. The post-mix beverage dispenser 10 includes a carbonator CT to which water is supplied from a pump P1. The carbonator CT is also supplied with $CO^2$ gas from conduit CG, as indicated, in a conventional manner, and carbonated water is output through a conduit CW. Pump P1 in the system illustrated is a turbine-type pump which is operated in order to achieve a flow rate of 1.3 liters per minute, and develop a water pressure sufficient to overcome the $CO^2$ pressure within carbonator CT. Both pumps may be coupled to a 3-part pressure sensor PS which monitors pressure in inlet 24. A low-pressure in inlet 24 indicates a low water level. When such a low-level signal is sensed, switch PS will shut down both pumps. An alternate construction would place place the pressure sensor in conduit C.

In order to accurately match the flow rates and pressures of the turbine-type pump P1, it would normally be necessary to provide sophisticated flow rate and pressure control systems for the pump P2 of the water reservoir assembly 14. However, in accordance with the present invention, the pump P2 is a centrifugal pump which has a sufficient amount of slippage so that it will adjust to the flow rate of the pump P1 regardless of the speed at which pump P2 is operated. Accordingly, when pump P2 is operated in unison with pump P1, the flow rates controlled by pump P1 and the water pressure become compatible throughout the system in spite of the presence of the filter F, and in spite of the speed at which pump P2 is operated. Therefore, a totally compatible water system is provided between the water reservoir assembly 14 and post-mix dispenser 10, making it easy to retrofit the water reservoir assembly to a conventional type of post-mix beverage dispenser, as illustrated.

The centrifugal pump P2, for use in the assembly of the present invention, may be a Gorman-Rupp Industries, High-Speed Centrifugal Pump that produces 0.5 gpm at 15 psi with maximum flow of 1 gpm and maximum head of 17 psi.

The activated charcoal filter F, utilized in the assembly of the present invention, may be a commercially-available type manufactured by Omnipure Filter Company.

It should be understood that the system and assembly described hereinabove may be modified as would occur to one of ordinary skill in the art without departing from the spirit and scope of the present invention.

What is claimed is:

1. A manually refillable water reservoir assembly for supplying water to a post-mix beverage dispenser at a pressure and flow rate compatible with the operation of the dispenser comprising:

(a) a manually refillable water container including, 1. a sealable access opening in a sidewall of the container through which it is fillable with water,
2. vent means including an aperture in said sidewall above the access opening, whereby the aperture is above the water level in said container during both the filling of said container while resting on an opposed sidewall, and the dispensing of water from said container through said spout while resting on the bottom wall thereof,
3. a discharge spout in a bottom wall thereof normally closed, and
4. a normally closed check valve in the discharge spout; and (b) water processing means including, 1. a housing having a socket for removably receiving the discharge spout of said container,
2. a pump means having an inlet fluidly connected to said socket and an outlet for supplying water to said dispenser, and
3. actuator means in said socket for opening said check valve in response to said spout of said container being plugged into said socket.

2. The reservoir assembly of claim 1 wherein said access opening is large enough to permit a human hand to protrude into the container to facilitate cleaning thereof.

* * * * *